US009395153B2

(12) United States Patent
Bottrell

(10) Patent No.: US 9,395,153 B2
(45) Date of Patent: Jul. 19, 2016

(54) FIREARM MAGAZINE HOLDER

(71) Applicant: Andrew Lee Bottrell, San Diego, CA (US)

(72) Inventor: Andrew Lee Bottrell, San Diego, CA (US)

( * ) Notice: Subject to any disclaimer, the term of this patent is extended or adjusted under 35 U.S.C. 154(b) by 81 days.

(21) Appl. No.: 14/519,976

(22) Filed: Oct. 21, 2014

(65) Prior Publication Data

US 2016/0109208 A1 Apr. 21, 2016

(51) Int. Cl.
*F41C 27/00* (2006.01)

(52) U.S. Cl.
CPC ..... *F41C 27/00* (2013.01)

(58) Field of Classification Search
CPC ..... F41C 9/085; F42B 39/00
USPC ..... 42/90, 106, 87; 206/3; 224/931, 239, 224/196
See application file for complete search history.

(56) References Cited

U.S. PATENT DOCUMENTS 3,938,717 A 2/1976 Theodore
4,120,109 A * 10/1978 Musgrave ..... F42B 39/02 42/90
5,243,442 A * 9/1993 Narukawa ..... H04N 1/38 358/452
6,668,479 B1 * 12/2003 Obong ..... F41A 9/68 206/3
8,555,538 B2 * 10/2013 Huffines ..... F41A 9/65 206/3
8,640,374 B1 * 2/2014 Reichelt ..... F41C 27/00 42/106
9,182,205 B2 * 11/2015 Sitz ..... F41A 23/18

FOREIGN PATENT DOCUMENTS

EP 2588833 A1 5/2013
WO 2012012837 A1 2/2012

OTHER PUBLICATIONS

Torrent Loading System's FreeLoader RLS—You Tube video created by Paul J. Shaskan, MS, MEd., Chief Executive Officer, CEO at Torrent Loading Systems, LLC, available at: https://www.youtube.com/watch?v=x2Vn1Pjvjyg.
Torrent Loading Systems—Facebook page, available at: https://www.facebook.com/torrent.loading.systems.
Torrent Loading Systems—Blogspot page, available at: http://torrentloadingsystems.blogspot.com/.
Linked in Profile page for Paul J. Shaskan, MS, MEd., Chief Executive Officer, CEO at Torrent Loading Systems, LLC, available at: www.linkedin.com/pub/paul-j-shaskan-ms-med/37/27a/a4a.

* cited by examiner

*Primary Examiner* — Reginald Tillman, Jr.
(74) *Attorney, Agent, or Firm* — EIP US LLP

(57) ABSTRACT

Embodiments disclosed herein provide an improved firearm magazine holder including features such as a guide ramp configured to guide a firearm while inserting a magazine held by the magazine holder into the firearm; a guide ramp configured to help guide the firearm away from the magazine holder once a magazine is inserted into the firearm; a magazine spacer; a base wall; and a magnet configured to attach to the magazine by magnetic force.

14 Claims, 3 Drawing Sheets

FIREARM MAGAZINE HOLDER

BACKGROUND OF THE INVENTION

This invention relates to firearm magazine holders, and more particularly, to firearm magazine holders from which one or more firearm magazines may be quickly and easily inserted into a firearm.

Generally, a firearm that utilizes a magazine for holding ammunition only has the ability to hold one magazine at a time. Consequently, firearm users may desire to carry replacement magazines. For example, users such as police officers, armed forces personnel, hunters, competition shooters, and even recreational shooters often carry additional magazines in magazines holders attached to their person in order to have quick and easy access to additional ammunition-carrying magazines.

Conventional magazine holders include, for example, magazine pouches, which are typically constructed as a multi-sided pocket with a bottom, such that a magazine slides into the pocket, with its base protruding. Such conventional magazine holders often include magazine fasteners, such as flaps or straps, intended to fasten the magazine in the pouch and retain the magazine in a fixed position. For example, a cover flap may be folded over the magazine and fastened to the pouch in order to retain the magazine in the pouch.

Because firearm magazines are often angled from top to bottom in order to match the angle of a corresponding firearm's grip or magazine holder, conventional magazine pouches are usually designed to receive the magazine such that the magazine is held in a sideways orientation relative to the user's body. By orienting the magazine sideways relative to the user's body, the magazine does not protrude from the user's body based on the angle of the magazine from top to bottom.

Conventional magazine holders have many disadvantages. For magazine holders that include a magazine fastener, a user must unfasten the magazine fastener before the magazine can be withdrawn. In situations where speed of withdrawing the magazine is critical, such as high-performance shooting competitions or combat situations, the need to unfasten the magazine fastener is disadvantageous. Consequently, some conventional magazine holders eliminate magazine fasteners and instead rely on tightness of fit to retain the magazines in position in the pouch. However, these types of magazine holders also have disadvantages. For example, in order to maintain a tight fit, a pouch must necessarily be sized to fit a particular type of magazine. As such, a user may need a different pouch for each type of magazine. Further, some magazines include structures at the bottom of the magazine that are larger than the cross-section of the ammunition carrying portion of the magazine and, as such, the magazine may only be loaded into such pouches in one direction—top-down (i.e. ammunition loading side down).

Accordingly, there is a need for improved magazine holders that allow secure retention of one or more magazines while also allowing quick access to the one or more magazines.

SUMMARY

Various embodiments described below relate to an improved firearm magazine holder. In one embodiment, a firearm magazine holder comprises: a first guide ramp configured to guide a firearm while inserting a magazine held by the magazine holder into the firearm; a second guide ramp configured to guide the firearm away from the magazine holder once the magazine is inserted into the firearm; a magazine spacer; and a base wall.

Certain embodiments of the firearm magazine holder further comprise: a magnet configured to attach to the magazine by magnetic force.

Certain embodiments of the firearm magazine holder further comprise: a means for attaching the magazine holder to a user.

Certain embodiments of the firearm magazine holder further comprise: a top wall.

Certain embodiments of the firearm magazine holder further comprise: a top guide configured to guide the firearm toward the magazine before the magazine is inserted into the firearm.

Certain embodiments of the firearm magazine holder further comprise: a first magazine channel formed between a first inner wall of the magazine holder and a first wall of the magazine spacer.

Certain embodiments of the firearm magazine holder further comprise: a second magazine channel formed between a second inner wall of the magazine holder and a second wall of the magazine spacer.

Certain embodiments of the firearm magazine holder further comprise: a first fastener configured to fasten the magazine spacer to the magazine holder.

Certain embodiments of the firearm magazine holder further comprise: a plurality of fastener receptacles.

In certain embodiments of the firearm magazine holder, the magnet includes a hole configured to allow insertion of a fastener.

In certain embodiments of the firearm magazine holder, the magazine spacer further comprises a moveable sidewall biased by a spring.

In certain embodiments of the firearm magazine holder, the magazine holder further comprises a moveable sidewall biased by a spring.

In certain embodiments of the firearm magazine holder, the means for attaching the magazine holder to the user is a clip.

In certain embodiments of the firearm magazine holder, the means for attaching is one of a clip, a locking clip, a fastener, a clamp, a buckle, a button, a pin, a tie, a magnetic plate, or a hook-and-loop fastener.

In certain embodiments of the firearm magazine holder, the magnet is a neodymium magnet.

DETAILED DESCRIPTION OF CERTAIN INVENTIVE EMBODIMENTS

Figure 1A:
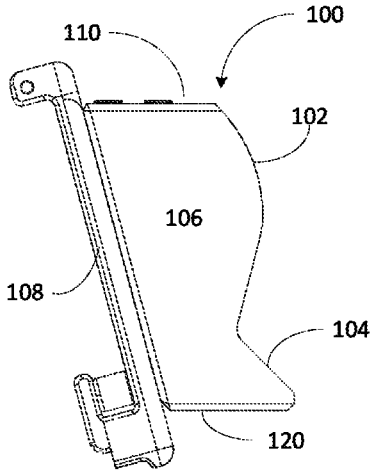
FIG. 1A is a side view of an improved firearm magazine holder.

Embodiments disclosed herein provide an improved firearm magazine holder for use by, for example, law enforcement personnel, armed forces personnel, hunters, competition shooters, recreational shooters, and the like.

The term "magazine" as used throughout this specification refers to a removable ammunition storage and feeding device that may be used with a firearm, as known by those of skill in the art. Firearm magazines may be used with a variety of types of firearms, including rifles, machine guns, sub-machine guns, assault rifles, pistols, and others as are known in the art. Magazines are typically designed to interface with a particular type of firearm and are therefore typically firearm-specific.

For example, magazines for handguns are generally designed to slot into a handle of the handgun with the ammunition loading side up and the ammunition oriented towards the front of the firearm. As such, magazines for handguns are typically longitudinal in length, with a generally rectangular cross-section, being narrower across the width of the handgun than in depth. Magazines for handguns generally project upwards from their base at an angle that complements the angle at which the handgun grip projects from the main body of the handgun. Magazines for other types of guns, such as rifles, may be designed to slot into a magazine receiver that may be placed away from a handle or stock of the rifle. As such, these magazines may not need to project at an angle from their base, but might instead project straight upward from their base.

Magazines may be designed to hold a "single-column" or "single-stack" of ammunition i.e. a stack of ammunition stacked one on top of another from base to top, or may be designed to hold a "double-column" or "staggered-stack" or "double-stack" of ammunition i.e. a stack of ammunition where the centerline of each stacked cartridge is offset laterally from the cartridge above and below. Some firearms may be compatible with one or both of a single-stack magazine or a double-stack magazine.

Generally, a magazine functions to move ammunition cartridges to the top of the magazine by a cartridge follower driven by a spring compressed against a base plate of the magazine.

Embodiments of an improved firearm magazine holder may include several features configured to improve the ease and speed of accessing and inserting magazines into firearms. For example, an improved firearm magazine holder may use one or more magnets to hold one or more magazines to the holder. In some embodiments, the magnets exhibit very strong magnetic fields, such as neodymium magnets, samarium-cobalt magnets, and other magnets as are known in the art. Using a magnet to hold a magazine to the magazine holder may reduce or completely eliminate the need for structures, such as pouches and fasteners, to hold the magazine. More importantly, the size and shape of the magazine holder need not be dictated by the size and shape of the magazine so long as the magnet has sufficient strength and surface area of the magazine to engage. Further, using magnets allows a magazine to be attached the magazine holder by merely getting the magazine close enough to the holder such that the magnetic force causes the magazine to attach to the magazine holder. Similarly, the detachment of the magazine from the magazine holder, when using magnets to retain the magazine, is a simple matter of overcoming the force of the magnet. Finally, the size, shape, and number of magnets used may be configured to customize the amount of attachment force applied to the magazine. In some embodiments, a weaker or smaller magnet may be used in order to reduce the detachment force, and/or because the magazine is smaller and lighter in weight. In other embodiments, a stronger or larger magnet may be used in order to increase the detachment force, and/or because the magazine is larger and heavier in weight.

Embodiments of an improved firearm magazine holder may also include one or more guide ramps of a first type configured to guide a firearm while inserting a magazine held by a magazine holder into the firearm. The guide ramp may cause the firearm to follow a path that will detach the magazine from the magazine holder as the magazine is inserted into the firearm. For example, a guide ramp may guide the base of a pistol in such a fashion that the pistol base causes the magazine to detach from the magazine holder as the pistol slides down the ramp.

Embodiments of an improved firearm magazine holder may also include one or more guide ramps of a second type configured to help guide a firearm away from the magazine holder once a magazine is securely seated in the firearm. These guide ramps may, for example, guide the base of a pistol away from the magazine holder (and user) after the user completes the action of inserting the magazine in the pistol.

Embodiments of an improved firearm magazine holder may also include a magazine spacer. A magazine spacer may, for example, be placed in such a manner as to form two or more magazine channels sized specifically for the particular type of magazine being used. In some embodiments, the magazine spacer may be removable such that different magazine spacers may be used with a single magazine holder, thereby enabling a magazine holder to be customized for different sizes and shapes of magazines. Further, in some embodiments, the magazine spacer may have a contour that matches one or more guide ramps such that a firearm is supported on both sides of its centerline as it is slid down on top of a magazine in the magazine holder. In such embodiments, the magazine spacer may act as an additional guide ramp. Further, the magazine spacer may be sized and shaped such that the magazine will only attach to the magazine holder in a particular configuration and position. For example, the magazine spacer may cause a magazine to naturally align itself in the middle of a magazine channel and to orient itself such that the front of the magazine (i.e. the side holding the projectile portion of the ammunition stored within) is facing away from a user. Such an orientation may be beneficial to a user because it naturally aligns the magazine with the weapon in the direction of fire (i.e. out and away from the user).

Embodiments of an improved firearm magazine holder may also include a base wall configured to support the magazine in the vertical direction (e.g. against gravity) and to provide a counter-force when a magazine is being inserted into a firearm. For example, as a portion of a firearm is slid down a guide ramp in order to insert the magazine into the firearm, the magazine holder base wall may provide a counter-force to fully insert the magazine in the firearm.

Embodiments of an improved firearm magazine holder may also include a means for attaching the magazine holder to a user. For example, the magazine holder may include a clip, a locking clip, a fastener, a clamp, a buckle, a button, a pin, a tie, a magnetic plate, a hook-and-loop fastener (e.g. VELCRO®), or other attachment means as are known in the art. Such attachment means may allow a user to attach the magazine holder to their person e.g. to a belt, to a harness, to a pair of pants, or to other types of apparel.

Embodiments of an improved firearm magazine holder may made of any suitable material as known by those of skill in the art, such as, for example, plastic, polymer, metal, poly resin, carbon fiber, wood, and others. In some embodiments, different aspects of a magazine holder are made of different materials. For example, the main body of the magazine holder may be made of a lightweight plastic while guide ramps are made of metal for strength and durability.

Embodiments of an improved firearm magazine holder may have varying shapes, dimensions, weights, etc. based on factors such as the number and type of magazines to be held and user preferences. Further, the materials making up the improved firearm magazine holder may be naturally colored or processed to take on different colors and/or patterns of colors. For example, embodiments of improved magazine holders may be processed to include patterns such as camouflage, text, or artwork such as logos, credentials, symbols, etc.

Embodiments of an improved firearm magazine holder may include specific coatings, textures, and/or patterns of material to improve performance of the magazine holder in use. For example, low friction and long wear coatings (e.g. TEFLON®) may be applied to guide ramps to help firearms slide down the ramps with less effort and less wear. As another example, textured surfaces on the inner walls and on the magazine spacer may help promote grip of a magazine while attached to the magazine holder. Further, textures, fabrics, and/or other materials may be placed over portions of a magazine holder for aesthetic reasons as well as functional reasons (e.g. to prevent scratching of metal components of a firearm and/or magazine when interfacing with the magazine holder).

Embodiments of an improved firearm magazine holder may be manufactured by known methods such as injection molding, milling, CNC routing, additive manufacturing, and other as are known in the art. In particular, additive manufacturing, such as 3D printing, may provide for the manufacturing of virtually limitless configurations of improved firearm magazine holders.

Embodiments of an improved firearm magazine holder may offer advantages over known magazine holders, such as magazine pouches. For example, embodiments of an improved firearm magazine holder allow for a user to insert a magazine into a firearm without taking the user's hand(s) off the firearm. That is, the user need not dedicate a free hand to unfastening a magazine fastener, removing a magazine from a pouch, and then inserting the magazine into the firearm. Rather, a user may simply move the firearm down and over the magazine holder to load a new magazine with very little or no distraction from the shooting activity. This advantage is particularly useful in law enforcement and military contexts where it is advantageous to be focused on targets and not reloading. Similarly, for competition shooters, improved magazine holders offer a significant time advantage when reloading a firearm in order to continue firing at targets in a timed competition. Additionally, improved magazine holders may benefit users who are unable to use a second free hand to reload a firearm because of injury, disability, or other impediment.

Embodiments of an improved firearm magazine holder may offer other advantages, such as maintaining an outward orientation of the firearm relative to the user while reloading. Unlike known magazine holders that orient magazines such that the ammunition is oriented across a user's body, embodiments of improved firearm magazines described herein orient the ammunition such that it is oriented away from a user, and towards a direction of fire.

Exemplary embodiments of improved firearm magazine holders will now be described with reference to the figures.

FIG. 1A is a side view of an improved firearm magazine holder 100. FIG. 1A depicts an outer sidewall 106, a top wall 110, a base wall 120, a first guide ramp 102 as well as a second guide ramp 104 of magazine holder 100. As described above, first guide ramp 102 may be used to guide a firearm while inserting a magazine held by a magazine holder 100 into the firearm. Also described above, second guide ramp 104 may be used to guide a firearm away from magazine holder 100 after a magazine is fully seated in the firearm. Finally, FIG. 1A depicts an attachment clip 108 configured to be attached to a user's apparel, such as a user's belt.

Figure 1B:
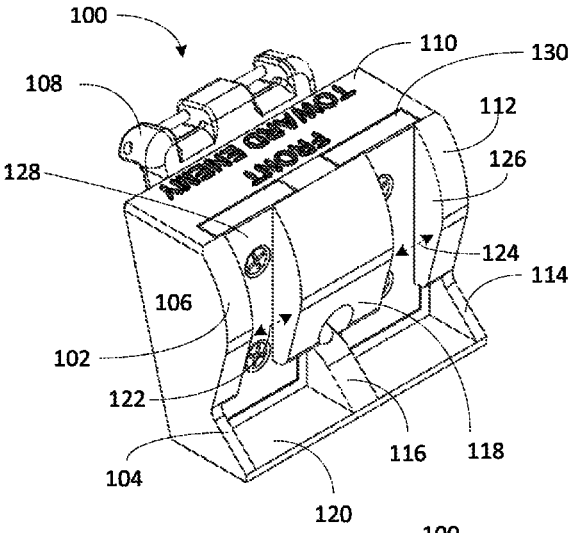
FIG. 1B is an isometric view of an improved firearm magazine holder.

FIG. 1B is an isometric view of magazine holder 100 depicting additional features. Magazine holder 100 includes a top wall 110 with optional text inscribed thereupon. The text on top wall 110 may be used to display instructions to a user (as shown), or for brand names, graphics, etc. Magazine holder 100 also includes a third guide ramp 112 and a fourth guide ramp 114 with the same purposes as guide ramps 102 and 104, described above. Additionally, magazine holder 100 includes a fifth guide ramp 116 configured for the same purpose as guide ramps 104 and 114, but located in such a fashion as to engage an opposing side of a firearm from either guide ramp 104 or 114. For example, guide ramp 104 may engage a right-side portion of a firearm while guide ramp 116 engages a left-side portion of a firearm such that the firearm is supported from both sides when sliding down the ramps.

Magazine holder 100 also includes magazine spacer 118, which is removably attached to magazine holder 100 by way of a fastener, such as a screw. Other types of fasteners may include a bolt, a stud, and other types as are known in the art. In the embodiment depicted in FIG. 1B, magazine spacer 118 is shaped such that it forms a guide ramp that matches the contour of guide ramps 102 and 112. In other embodiments, a magazine spacer may have a different contour, such as, for example, a contour that matches both guide ramps 102 and 112, as well as 104 and 114. Magazine spacer 118 includes two sidewalls that help form first and second magazine channels 122 and 124. For example, the sidewall of magazine spacer 118 and inner sidewall 126 of magazine holder 100 form second magazine channel 124. In this embodiment, the sidewalls of magazine spacer 118 are parallel with the inner sidewalls of the magazine holder (e.g. 126), however, in other embodiments, these walls may be set at an angle in order to guide a magazine (not shown) into the magazine channel easily. Generally, the shape of the magazine spacer may be customized to accommodate easy alignment and attachment of a magazine to magazine holder 100.

In some embodiments, magazine spacer 118 may have moveable sidewalls biased by, for example, a spring, so that the sidewalls may move laterally to accommodate different sizes of magazines. Alternatively, in some embodiments, magazine holder 100 may have moveable inner sidewalls (e.g. 126) biased by, for example, a spring, so that the inner sidewalls may move laterally to accommodate different sizes of magazines. In some embodiments, both the inner sidewalls of magazine holder 100 and the sidewalls of the magazine spacer 118 may be moveable to accommodate different sizes of magazines while providing biased lateral support for one or more magazines.

In the embodiment depicted in FIG. 1B, the magazine spacer 118 creates two magazine channels 122 and 124. However in other embodiments, more than two magazine channels may be created by, for example, the use of more than one magazine spacer. For example, a second magazine spacer (not shown) may be used to create a third magazine channel (not shown).

Magazine holder 100 also includes magnets 128 and 130. In this embodiment, magnets 128 and 130 are attached to magazine holder 100 by screw fasteners so that they are removable. As such, magnets 128 and 130 includes holes through which a fastener may be inserted. In this configuration, a user may choose to use different magnets with different characteristics (e.g. magnetic strength, size, shape, weight, etc.) by simply unfastening and refastening a different magnet. The type of magnet used may be based on, for example, the type of magazine intended to be used with magazine holder 100. In other embodiments, a single magnet, such as a magnet spanning the whole or some portion of the width of magazine holder 100 between the inner walls, may be used instead of multiple magnets. In yet other embodiments, magnets 128 and 130 may be attached to magazine holder 100 by different means, such as liquid adhesive (e.g. glue), solid adhesive (e.g. double-sided tape), compression fit, hook-and-loop fastener, rivet, and others as are known in the art. In further embodiments, the magnets may be molded into the body of magazine holder 100 such that they are not outwardly visible.

In the embodiment depicted in FIG. 1B, magnets 128 and 130 as well as magazine spacer 118 are attached to magazine holder 100 with screw fasteners. The ability to attach various components such as magnets and magazine spacers to magazine holder 100 allows for a high degree of customization of the configuration of magazine holder 100. For example, the number of magazines as well as size of magazines can easily be accommodated on magazine holder 100 by choosing appropriate magnets and magazine spacers. In some embodiments, magazine holder 100 includes a grid of fastener receptacles, such as, for example, threaded screw holes (not shown), so that different configurations of magnets and magazine spacers can be attached to magazine holder 100 with similar fasteners (e.g. screws). Other types of fastener receptacles may include hardware such as a nut, a recess configured to hold a nut, a compression fit recess, a tongue and/or groove Magazine holder 100 also include base wall 120. As described above, base wall 120 may provide vertical support to one or more magazines, which prevent the magazines from sliding downward when attached to magazine holder 100. Additionally, magazine holder 100 may provide a counterforce so that a user may apply sufficient pressure to the magazine to fully seat it within the firearm. In the embodiment depicted in FIG. 1B, base wall 120 is flat and parallel with top wall 110. However, in other embodiments, base wall 120 may be at an angle or may have additional contour.

Figure 1C:
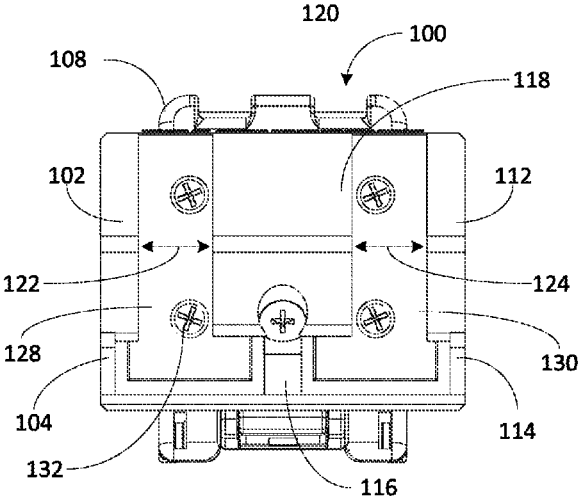
FIG. 1C is a front view of an improved firearm magazine holder.

FIG. 1C is a front view of an improved firearm magazine holder 100 depicting features described above, including first guide ramp 102, second guide ramp 104, third guide ramp 112, fourth guide ramp 114, fifth guide ramp 116, magazine spacer 118, first magazine channel 122, second magazine channel 124, attachment clip 108, first magnet 128, and second magnet 130. Further, FIG. 1C denotes an exemplary fastener, screw 132.

Figure 2A:
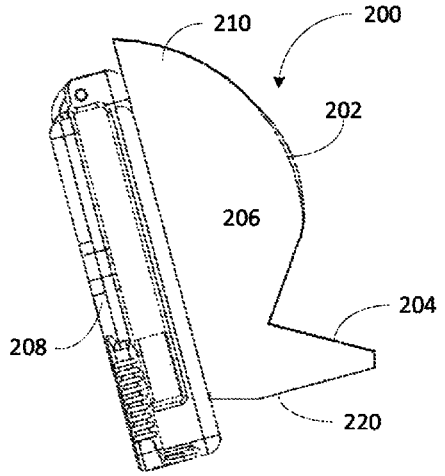
FIG. 2A is a side view of an improved firearm magazine holder.

FIG. 2A is a side view of another embodiment of an improved firearm magazine holder 200. FIG. 2A depicts an outer sidewall 206, a top guide 210, a base wall 220, a first guide ramp 202 as well as a second guide ramp 204 of magazine holder 200. As described above, first guide ramp 202 may be used to guide a firearm while inserting a magazine held by magazine holder 200 into the firearm. Also described above, second guide ramp 204 may be used to guide a firearm away from magazine holder 200 after a magazine is fully seated in the firearm. Finally, FIG. 2A depicts an attachment clip 208 configured to be attached to a user's apparel, such as a user's belt. In this embodiment, attachment clip 208 is a BLADE-TECH™ TEK-LOK™. In other embodiments, other attachment means may be used as described above and as are known in the art.

Figure 2B:
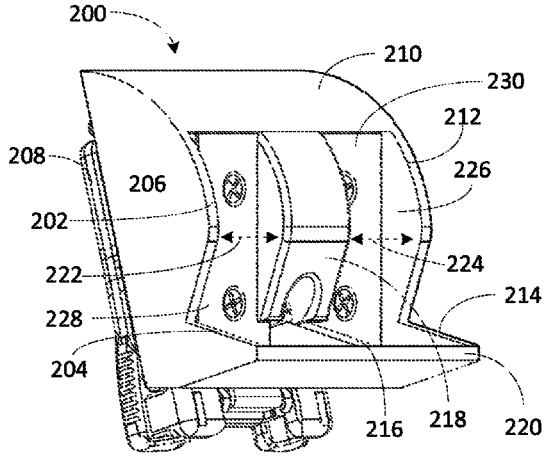
FIG. 2B is an isometric view of an improved firearm magazine holder.

FIG. 2B is an isometric view of magazine holder 200 depicting additional features. Here, magazine holder 200 includes a top guide 210 (as compared to top wall 110 in FIGS. 1A-1C). Top guide 210 is configured to help guide the initial contact of a firearm, such as a pistol, with the magazine holder 200. In particular, the curved surface of top guide 210 allows for a firearm to engage and then slide down and towards a magazine (not shown) attached to magazine holder 210. As such, top guide 210 may assist with aligning a firearm with a magazine held by magazine holder 200 before the magazine is initially inserted into the firearm. Further, in the depicted embodiment, top guide 210 flows continuously into guide ramps 202 and 212. However, in other embodiment, this may not be the case, and the top guide may have a different contour suited to a particular type of magazine or firearm. Further, in other embodiments, top guide 210 may also have guide channels (not shown) running down top guide 210 and towards magazine channels 222 and 224. Such guide channels may help further guide a firearm into position to receive a magazine.

FIG. 2B also depicts a third guide ramp 212 and a fourth guide ramp 214 with the same purposes as guide ramps 202 and 204, described above. Additionally, magazine holder 200 includes a fifth guide ramp 216 configured for the same purpose as guide ramps 204 and 214, but located in such a fashion as to engage an opposing side of a firearm from either guide ramp 204 or 214.

Magazine holder 200 also includes magazine spacer 218, which is removably attached to magazine holder 200 by way of a fastener, such as a screw. In the embodiment depicted in FIG. 2B, magazine spacer 218 is shaped such that it forms a guide ramp that matches the contour of guide ramps 202 and 212, but in other embodiments, magazine spacer 218 may have a different contour, as described above. Magazine spacer 218 includes two sidewalls that help form first and second magazine channels 222 and 224. For example, the sidewall of magazine spacer 218 and inner sidewall 226 of magazine holder 200 form second magazine channel 224. In this embodiment, as with above, the sidewalls of magazine spacer 218 are parallel with the inner sidewalls of the magazine holder (e.g. 226), however, in other embodiments, these walls may be set at an angle in order to guide a magazine (not shown) into the magazine channel easily.

As with above, other embodiments of magazine spacer 218 may include moveable sidewalls biased by, for example, a spring, so that the sidewalls may move laterally to accommodate different sizes of magazines. Alternatively, in some embodiments, magazine holder 200 may have moveable inner sidewalls (e.g. 226) biased by, for example, a spring, so that the inner sidewalls may move laterally to accommodate different sizes of magazines. In some embodiments, both the inner sidewalls of magazine holder 200 and the sidewalls of the magazine spacer 218 may be moveable to accommodate different sizes of magazines while providing biased lateral support for one or more magazines.

In the embodiment depicted in FIG. 2B, the magazine spacer 218 creates two magazine channels 222 and 224. However in other embodiments, more than two magazine channels may be created by, for example, the use of more than one magazine spacer.

Magazine holder 200 also includes magnets 228 and 230. In this embodiment, magnets 228 and 230 are attached to magazine holder 200 by screw fasteners so that they are removable. In other embodiments, a single magnet, such as a magnet spanning the whole or some portion of the width of magazine holder 200 between the inner walls, may be used instead of multiple magnets. In yet other embodiments, magnets 228 and 230 may be attached to magazine holder 200 by different means, or molded into the body of magazine holder 200, as described above.

As with above, magazine holder 200 may include a grid of fastener receptacles, such as screw holes (not shown), so that different configurations of magnets and magazine spacers can be attached to magazine holder 200.

Magazine holder 200 also include base wall 220. As described above, base wall 220 provides vertical support to one or more magazines, and prevents the magazines from sliding downward when attached to magazine holder 200. Additionally, base wall 220 may provide a counter-force so that a user may apply sufficient pressure to a magazine to fully seat it within a firearm. In the embodiment depicted in FIG. 2B, base wall 220 is includes two angled segments. These angled segments may be designed, for example, to match the bottom plate of a magazine so as to provide a more secure seating when the magazine is attached to magazine holder 220.

Figure 2C:
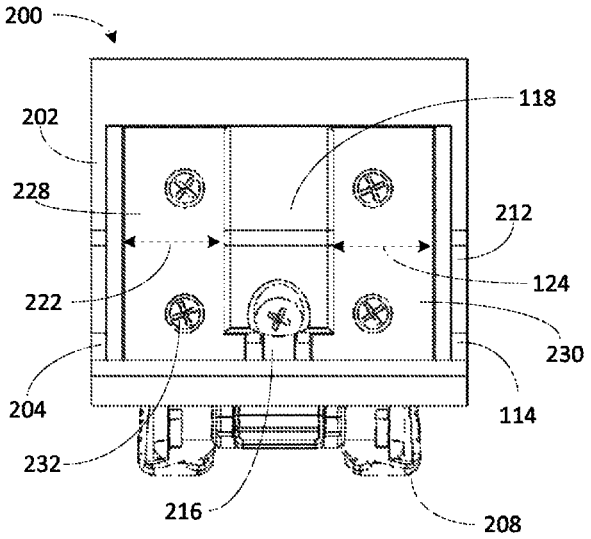
FIG. 2C is a front view of an improved firearm magazine holder.

FIG. 2C is a front view of an improved firearm magazine holder 200 depicting features described above, including first guide ramp 202, second guide ramp 204, third guide ramp 212, fourth guide ramp 214, fifth guide ramp 216, magazine spacer 218, first magazine channel 222, second magazine channel 224, attachment clip 208, first magnet 228, and second magnet 230. Further, FIG. 2C denotes an exemplary fastener, screw 232.

Figure 3A:
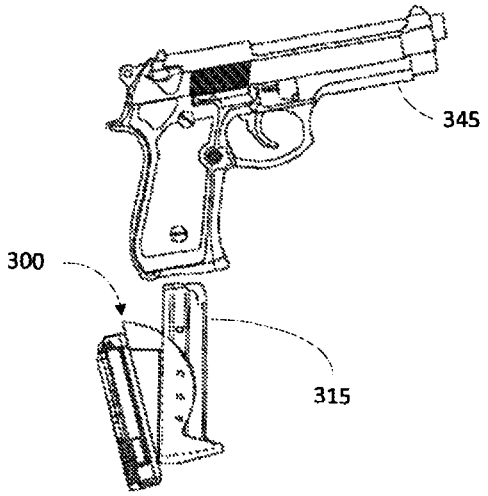
FIG. 3A depicts a step in a method of using a magazine holder.

FIG. 3A depicts a step in a method of using a magazine holder 300. Specifically, FIG. 3A depicts firearm 345 above an improved magazine holder 300, which may be a magazine holder according to the descriptions above. Magazine 315 is attached to magazine holder 300 via magnetic force from magnets (not shown) and is supported below by a base wall as described above. Notably, the magazine 315 is oriented outward from the magazine holder, i.e. such that the ammunition in the magazine faces away from a user (not shown), and such that the magazine is oriented to align with the firearm 345 that is also oriented away from the user. In this way, a user may make a natural motion with the firearm 345 from a firing position (e.g. with gun extended out and away from the user's body) down to the magazine holder 300 and then away from the magazine holder 300, as shown in the following figures.

Figure 3B:
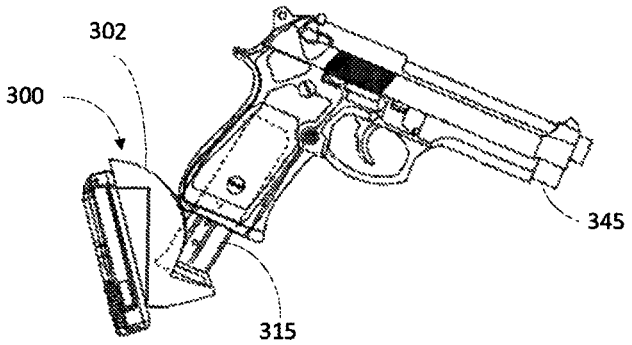
FIG. 3B depicts another step in a method of using a magazine holder.

FIG. 3B depicts another step in a method of using a magazine holder 300. Specifically, FIG. 3B depicts firearm 345 as it slides midway down first guide ramp 302. Notably, the guide ramp 302 causes the firearm to move in an arc-like motion path as the magazine 315 is taken up into the magazine cavity of firearm 345. This motion path causes the magazine 315 to detach from the magnet (not shown) in a smooth and easy fashion. The guide ramp 302 also causes the firearm 345 to rotate in such a way that the magazine 315 is moved away from the magazine holder 300 as it detaches from the magnet.

Figure 3C:
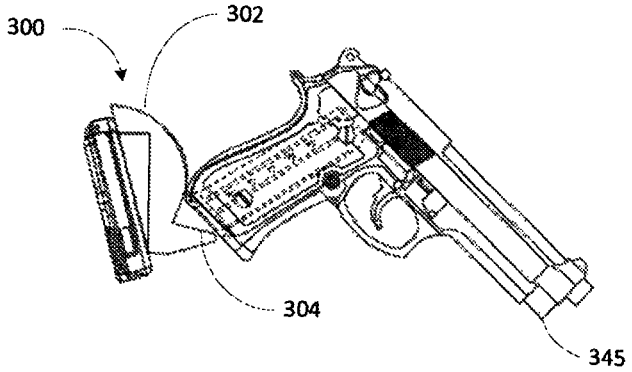
FIG. 3C depicts another step in a method of using a magazine holder.

FIG. 3C depicts another step in a method of using a magazine holder 300. Specifically, FIG. 3C depicts firearm 345 as it transitions from first guide ramp 302 to second guide ramp 304. Second guide ramp 304 directs firearm 345 away from magazine holder 300 and the user (not shown) after magazine 315 is fully seated in firearm 345.

Throughout the foregoing description, numerous specific details were set forth in order to provide a thorough understanding of the invention. It will be apparent, however, to one of ordinary skill in the art, that the invention may be practiced without some of these specific details or with modifications to the same. Accordingly, the scope and spirit of the invention should be judged in terms of the claims which follow.

What is claimed is:

1. A firearm magazine holder, comprising:

a first guide ramp configured to guide a firearm while inserting a magazine held by the magazine holder into the firearm;

a second guide ramp configured to guide the firearm away from the magazine holder once the magazine is inserted into the firearm; a magazine spacer; and a base wall, further comprising: a magnet configured to attach to the magazine by magnetic force.

2. The firearm magazine holder of claim 1, further comprising: a means for attaching the magazine holder to a user.

3. The firearm magazine holder of claim 1, further comprising: a top wall.

4. The firearm magazine holder of claim 1, further comprising: a top guide configured to guide the firearm toward the magazine before the magazine is inserted into the firearm.

5. The firearm magazine holder of claim 1, further comprising: a first magazine channel formed between a first inner wall of the magazine holder and a first wall of the magazine spacer.

6. The firearm magazine holder of claim 5, further comprising: a second magazine channel formed between a second inner wall of the magazine holder and a second wall of the magazine spacer.

7. The firearm magazine holder of claim 1, further comprising: a first fastener configured to fasten the magazine spacer to the magazine holder.

8. The firearm magazine holder of claim 7, further comprising: a plurality of fastener receptacles.

9. The firearm magazine holder of claim 1, wherein the magnet includes a hole configured to allow insertion of a fastener.

10. The firearm magazine holder of claim 1, wherein the magazine spacer further comprises a moveable sidewall biased by a spring.

11. The firearm magazine holder of claim 1, wherein the magazine holder further comprises a moveable sidewall biased by a spring.

12. The firearm magazine holder of claim 2, wherein the means for attaching the magazine holder to the user is a clip.

13. The firearm magazine holder of claim 2, wherein the means for attaching is one of a clip, a locking clip, a fastener, a clamp, a buckle, a button, a pin, a tie, a magnetic plate, or a hook-and-loop fastener.

14. The firearm magazine holder of claim 1, wherein the magnet is a neodymium magnet.

* * * * *